US008678842B2

(12) United States Patent
Adachi et al.

(10) Patent No.: US 8,678,842 B2
(45) Date of Patent: Mar. 25, 2014

(54) TERMINAL CONNECTION STRUCTURE

(75) Inventors: Hideomi Adachi, Kosai (JP); Hidehiko Kuboshima, Kosai (JP); Hajime Kato, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/813,070

(22) PCT Filed: Jul. 22, 2011

(86) PCT No.: PCT/JP2011/066734

§ 371 (c)(1),
(2), (4) Date: Jan. 29, 2013

(87) PCT Pub. No.: WO2012/014816

PCT Pub. Date: Feb. 2, 2012

(65) Prior Publication Data

US 2013/0130557 A1 May 23, 2013

(30) Foreign Application Priority Data

Jul. 30, 2010 (JP) ..... 2010-171822

(51) Int. Cl.
*H01R 13/15* (2006.01)

(52) U.S. Cl.
USPC ..... 439/263

(58) Field of Classification Search
USPC ..... 439/263, 262, 259, 708, 284
See application file for complete search history.

(56) References Cited

U.S. PATENT DOCUMENTS

| | | | | |
|---|---|---|---|---|
| 6,166,498 | A * | 12/2000 | Yamaguchi et al. | 318/34 |
| 6,533,696 | B1 * | 3/2003 | Takenaka et al. | 475/150 |
| 7,722,372 | B2 * | 5/2010 | Matsumoto et al. | 439/213 |
| 7,972,157 | B2 * | 7/2011 | Tanae et al. | 439/189 |

FOREIGN PATENT DOCUMENTS

| | | | |
|---|---|---|---|
| JP | 973926 | A | 3/1997 |
| JP | 2004213956 | A | 7/2004 |
| JP | 2004327184 | A | 11/2004 |
| JP | 2007234322 | A | 9/2007 |
| JP | 2009283391 | A | 12/2009 |

OTHER PUBLICATIONS

International Search Report dated Oct. 18, 2011 from the International Searching Authority in counterpart application No. PCT/JP2011/0066734.

Written Opinion dated Oct. 18, 2011 from the International Searching Authority in counterpart application No. PCT/JP2011/0066734.

* cited by examiner

*Primary Examiner* — Phuong Dinh

(74) *Attorney, Agent, or Firm* — Sughrue Mion, PLLC

(57) ABSTRACT

A terminal connection structure 1 includes first terminal fittings 5 connected to a motor 7, second terminal fittings 22 connected to an inverter, and a clip terminal. The first terminal fittings 5 and the second terminal fittings 22 respectively includes electrical contact portions 8 and 27 formed in a band plate shape and superimposed on each other. The clip terminal is caused to approach the electrical contact portions 8 and 27 along a crossing direction with respect to the longitudinal direction of the electrical contact portions 8 and 27 superimposed on each other, and sandwiches the electrical contact portions 8 and 27 superimposed on each other, between a pair of the contact pieces 35.

5 Claims, 13 Drawing Sheets

TERMINAL CONNECTION STRUCTURE

TECHNICAL FIELD

The present invention relates to a terminal connection structure which connects electrical contact portions of terminal fittings to each other, and particularly relates to a terminal connection structure for connecting power supply devices to each other, to which a voltage is applied for driving a vehicle.

BACKGROUND ART

In the related art, in order to reduce the burden on the environment, hybrid vehicles or electric vehicles which are driven using a rotary drive force of a motor have been used. On such a type of hybrid vehicle or electric vehicle which is driven using the rotary drive force of the motor, a power supply device such as batteries, inverters, motors and generators, to which the voltage is applied for driving, is mounted. Due to a high voltage value of an electrical current flowing between the power supply devices, as a cable which connects the power supply devices to each other, a cable thicker than a wire harness cable which transmits a signal line or distributes a power to each electronic device is used. In addition, in order to connect these thick cables to the power supply devices, various terminal blocks (for example, refer to PTL 1) have been used in the related art.

The terminal block disclosed in the PTL 1 includes a plurality of band plate shaped terminal fittings, a housing of insulation properties which accommodates the terminal fittings, and a shield shell which covers the outside of the housing and is fixed to a casing body of the power supply device. The terminal fittings are configured of a thick metal plate and are connected to the power supply device. The terminal fittings are superimposed on the terminal fittings attached to a terminal of the cable, interposed by bolts and nuts which are screwed to each other, and then the terminal fittings are connected to each other. In order to secure a creeping distance between a plurality of the individual terminal fittings and to enable easy screwing of the bolts and nuts, plural terminal fittings are positioned on the same plane as each other. The housing is provided at the outer edge of the power supply device.

The terminal block connects the cable to the power supply device in such a manner that the bolts and nuts are screwed to each other, and the terminal fittings which are superimposed on each other are sandwiched therebetween.

CITATION LIST

Patent Literature

[PTL 1] JP-A-2004-327184

SUMMARY OF INVENTION

Technical Problem

In the terminal block in the related art, the housing has a tendency to be widened and enlarged because plural terminal fittings are positioned on the same plane as each other in the housing. Of course, it is necessary to connect the terminal block to a terminal such that electrical resistance between the terminal of a cable end is less than a desired resistance value.

Accordingly, an object of the present invention is to provide a terminal connection structure which enables miniaturization and reliable connection of terminal fittings to each other.

Solution to Problem

The object of the present invention is achieved by the following configuration.

(1) A terminal connection structure for connecting a first terminal fitting connected to a first power supply device and a second terminal fitting connected to a second power supply device; wherein each of the first terminal fitting and the second terminal fitting includes an electrical contact portion formed in a band plate shape, the electrical contact portions being superimposed on each other; the terminal connection structure includes a clip terminal including a pair of contact pieces sandwiching the electrical contact portion of the first terminal fitting and the electrical contact portion of the second terminal fitting which are superimposed on each other, and an urging connection portion that is continued from the pair of the contact pieces and urges the pair of the contact pieces between which the electrical contact portions of the first and second terminal fittings are sandwiched in a direction to approach each other; the clip terminal is caused to approach the electrical contact portions along a crossing direction with respect to the electrical contact portions of the first and second terminal fittings which are superimposed on each other, and that sandwiches the electrical contact portions of the first and second terminal fittings which are superimposed on each other, between the pair of the contact pieces.

(2) In the terminal connection structure of the configuration (1), the electrical contact portions of the first terminal fittings are plurally provided in parallel, being spaced apart from each other, and the electrical contact portions of the second terminal fittings are plurally provided in parallel, being spaced apart from each other.

(3) In the terminal connection structure of the configuration (1) or (2), between the electrical contact portions of the first terminal fittings and the electrical contact portions of the second terminal fittings, one side is configured of an aluminum alloy which is softer than a material configuring the other side.

(4) In the terminal connection structure of the configuration (3), between the electrical contact portions of the first terminal fittings and the electrical contact portions of the second terminal fittings, convex portions that protrude toward the one side are provided at the other side.

(5) In the terminal connection structure of the configuration (4), between the electrical contact portions of the first terminal fittings and the electrical contact portions of the second terminal fittings, the other side is configured of a harder metal than the one side.

Advantageous Effects of Invention

According to the terminal connection structure of the configuration (1), the electrical contact portions are connected to each other in such a manner that the electrical contact portions are sandwiched between a pair of the contact pieces of the clip terminal which is caused to approach the electrical contact portions along the crossing direction with respect to the longitudinal direction of the electrical contact portions of the first and second terminal fittings which are superimposed on each other. Therefore, even if the electrical contact portions of the first and second terminal fittings are disposed in parallel, being spaced apart from each other, it is possible to reliably connect the electrical contact portions to each other. Accordingly, it is possible to reduce the width of the terminal connection structure compared to a case where the surfaces of the electrical contact portions of the terminal fittings are disposed on the same plane by disposing the surfaces of the electrical contact portions formed in a band plate shape of the first and second terminal fittings in parallel, being spaced apart from each other. Consequently, it is possible to realize miniaturization of the terminal connection structure.

In addition, the clip terminal includes a pair of the contact pieces and an urging connection portion which urges a pair of the contact pieces in a direction to approach each other. Accordingly, by the electrical contact portions which are superimposed on each other being sandwiched between a pair of the contact pieces, it is possible to reliably and electrically connect the first terminal fittings and the second terminal fittings. Consequently, it is possible to reliably connect the terminal fittings to each other.

According to the terminal connection structure of the configuration (2), the electrical contact portions of the first and second terminal fittings are disposed in parallel, being spaced apart from each other. Accordingly, it is possible to reduce the width of the terminal connection structure compared to a case where the electrical contact portions of the terminal fittings are disposed on the same plane. Consequently, it is possible to realize the miniaturization of the terminal connection structure.

According to the terminal connection structure of the configuration (3), between the electrical contact portions of the first and second terminal fittings, one side is configured of an aluminum alloy. Therefore, when the clip terminals are urged in a direction where the electrical contact portions come into close contact with each other, the one side is deformed and then the electrical contact portions of the first and second terminal fittings are brought into close contact with each other. Consequently, it is possible to reliably connect the terminal fittings to each other.

According to the terminal connection structure of the configuration (4), the convex portions are provided at the other side between the electrical contact portions of the first and second terminal fittings, which is not configured of the aluminum alloy. Accordingly, when the clip terminal is urged in the direction where the electrical contact portions come into close contact with each other, the convex portion penetrates into the one side and thereby brings the electrical contact portions of the first and second terminal fittings reliably into close contact with each other. Consequently, it is possible to reliably connect the terminal fittings to each other.

According to the terminal connection structure of the configuration (5), the other side between the electrical contact portions of the first and second terminal fittings, which is not configured of the aluminum alloy, is configured of a harder metal than the aluminum alloy configuring the one side. Accordingly, when the clip terminals are urged in the direction where the electrical contact portions come into close contact with each other, the convex portions reliably penetrate into the one side and thereby bring the electrical contact portions of the first and second terminal fittings reliably into close contact with each other. Consequently, it is possible to further reliably connect the terminal fittings to each other.

DESCRIPTION OF EMBODIMENTS

Figure 1:
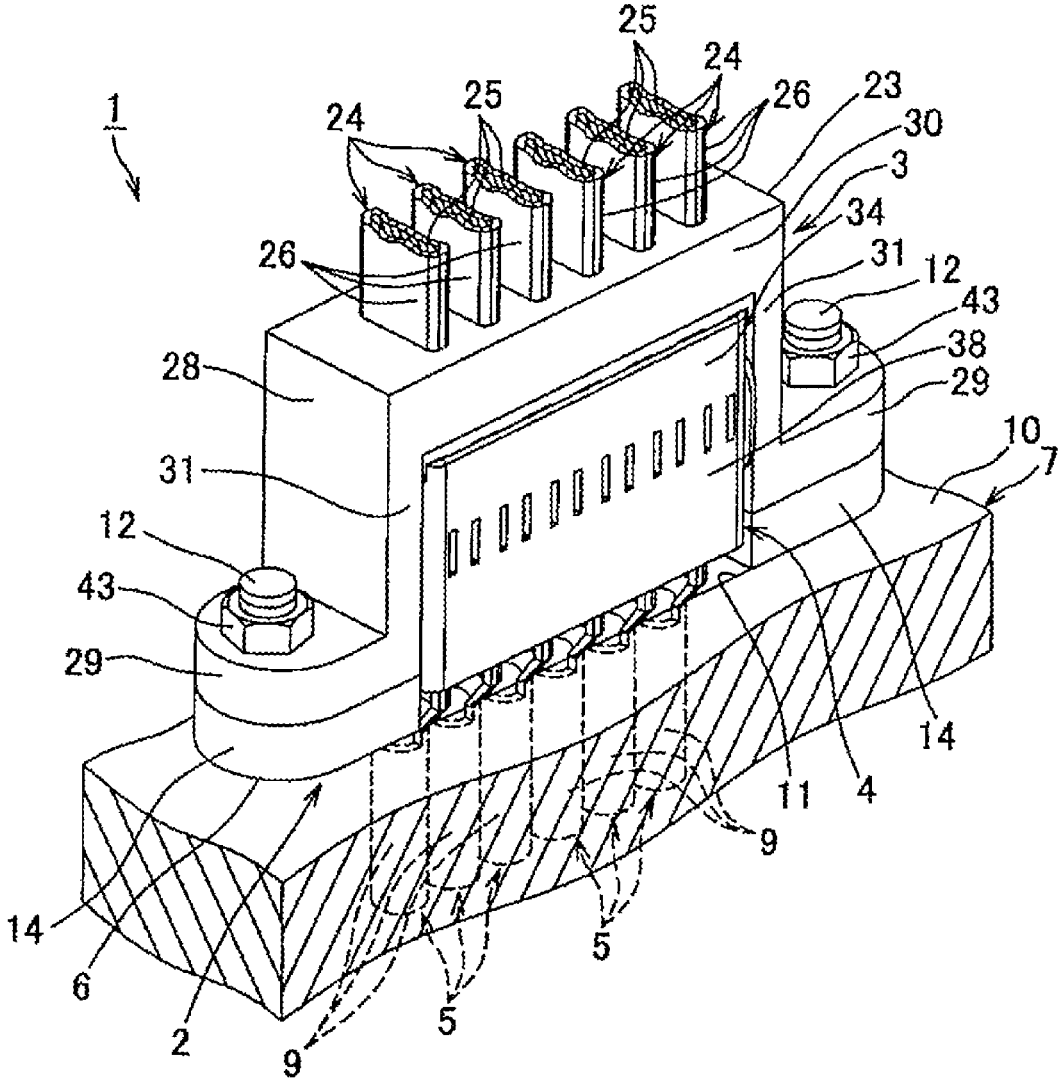
FIG. 1 is a perspective view of a terminal connection structure according to an embodiment of the present invention.
Figure 2:
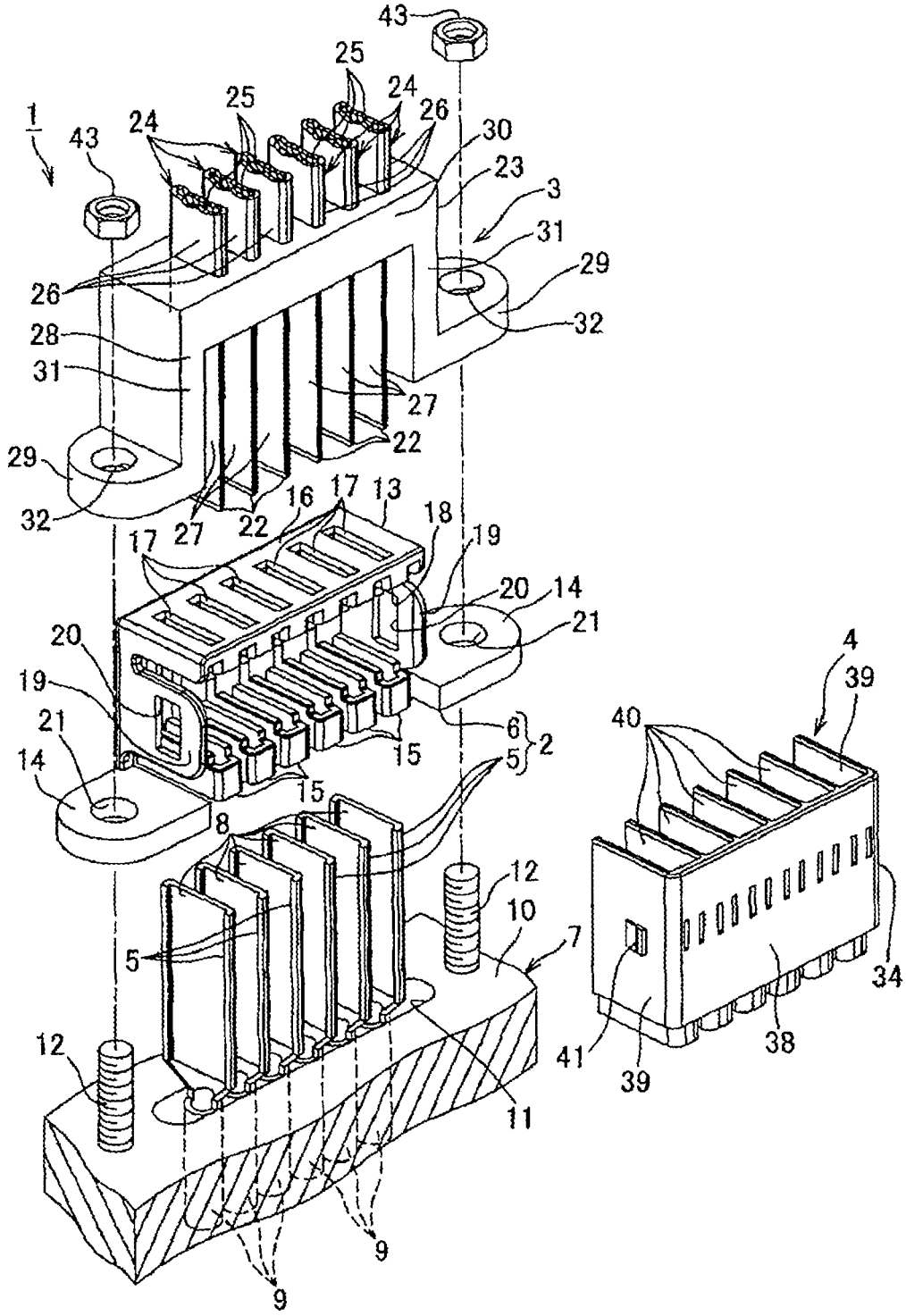
FIG. 2 is a perspective view illustrating an exploded terminal connection structure illustrated in FIG. 1.

Hereinafter, a terminal connection structure according to an embodiment of the present invention will be described with reference to FIGS. 1 to 13. As illustrated in FIGS. 1 and 2, a terminal connection structure 1 according to the present embodiment includes a first connector 2, a second connector 3 and a clip connector 4.

As illustrated in FIG. 2, the first connector 2 includes a plurality of first terminal fittings 5 and one connector housing 6. The first terminal fittings 5 are configured of a conductive metal. In the illustrated example, the first terminal fittings 5 are configured of a copper or a copper alloy as a harder metal than a material (metal) which configures second terminal fittings 22 (to be described later). A cable electrically connected to a coil of a motor 7 as a first power supply device is attached to the first terminal fittings 5. Therefore, the first terminal fittings 5 are electrically connected to the motor 7 as the first power supply device. Furthermore, the power supply device indicated in the present invention represents a device to which a voltage is applied for driving vehicles, such as a battery, an inverter, a motor and a generator.

The first terminal fittings 5 include an electrical contact portion 8 (illustrated in FIG. 12) formed in a band plate shape, and a wire connection portion 9 which is continued from the electrical contact portion 8 and has a cylindrical shape. The cable is connected to the wire connection portion 9, through which a core wire of the cable passes and which is crimped such that inside and outside diameters are shrunk. The first terminal fittings 5 are allowed to pass through a through hole 11 provided at a conductive motor case 10 configuring an outer shell of the motor 7. Of course, the first terminal fittings 5 are electrically insulated from the inner surface of the through hole 11, that is, the motor case 10. A plurality of the first terminal fittings 5 is disposed in a state where the electrical contact portions 8 are in parallel, being spaced apart from each other. That is, the electrical contact portions 8 of a plurality of the first terminal fittings 5 are disposed in a state where the surfaces (band plated shaped surfaces) of the electrical contact portions 8 are in parallel, being spaced apart from each other. Furthermore, in the illustration example, six of the first terminal fittings 5 are provided. Furthermore, a screw axis 12 is erected in the vicinity of the through hole 11 of the motor case 10. In the illustration example, two screw axes 12 are provided at a position where the through hole 11 is positioned between each of them.

The connector housing 6 is configured of insulating synthetic resin and includes a box shaped main body portion 13 integrally with two flange fixing portions 14. The main body portion 13 is superimposed on the motor case 10. The main body portion 13 is provided with the same number of cylindrical portions 15 through which the electrical contact portion 8 of the first terminal fittings 5 is allowed to pass inside thereof, as that of the number of first terminal fittings 5, at a position superimposed on the motor case 10. In addition, the main body portion 13 is provided with the same number of open holes 17 through which an electrical contact portion 27 of second terminal fittings 22 (to be described later) is allowed to pass, as that of the number of the second terminal fittings 22, at a wall 16 at the side separated from the motor case 10. In addition, the main body portion 13 has a notched hole 18 which is formed as if an outer wall of the main body portion 13 is notched between the cylindrical portion 15 and the wall 16. Of course, the notched hole 18 allows the inside and the outside of the main body portion 13 to communicate with each other. Furthermore, the main body portion 13 has an engaging arm 19 which engages with an engaging projection 41 of a connector housing 34 (to be described later) of the clip connector 4. The engaging arm 19, inside thereof, has a hole 20 into which the engaging projection 41 penetrates.

The flange fixing portions 14 are erected in an outward direction of the main body portion 13 from the edge close to the motor case 10 of the main body portion 13. The flange fixing portions 14, inside thereof, is provided with open holes 21 through which the screw axes 12 are allowed to pass.

Figure 3:
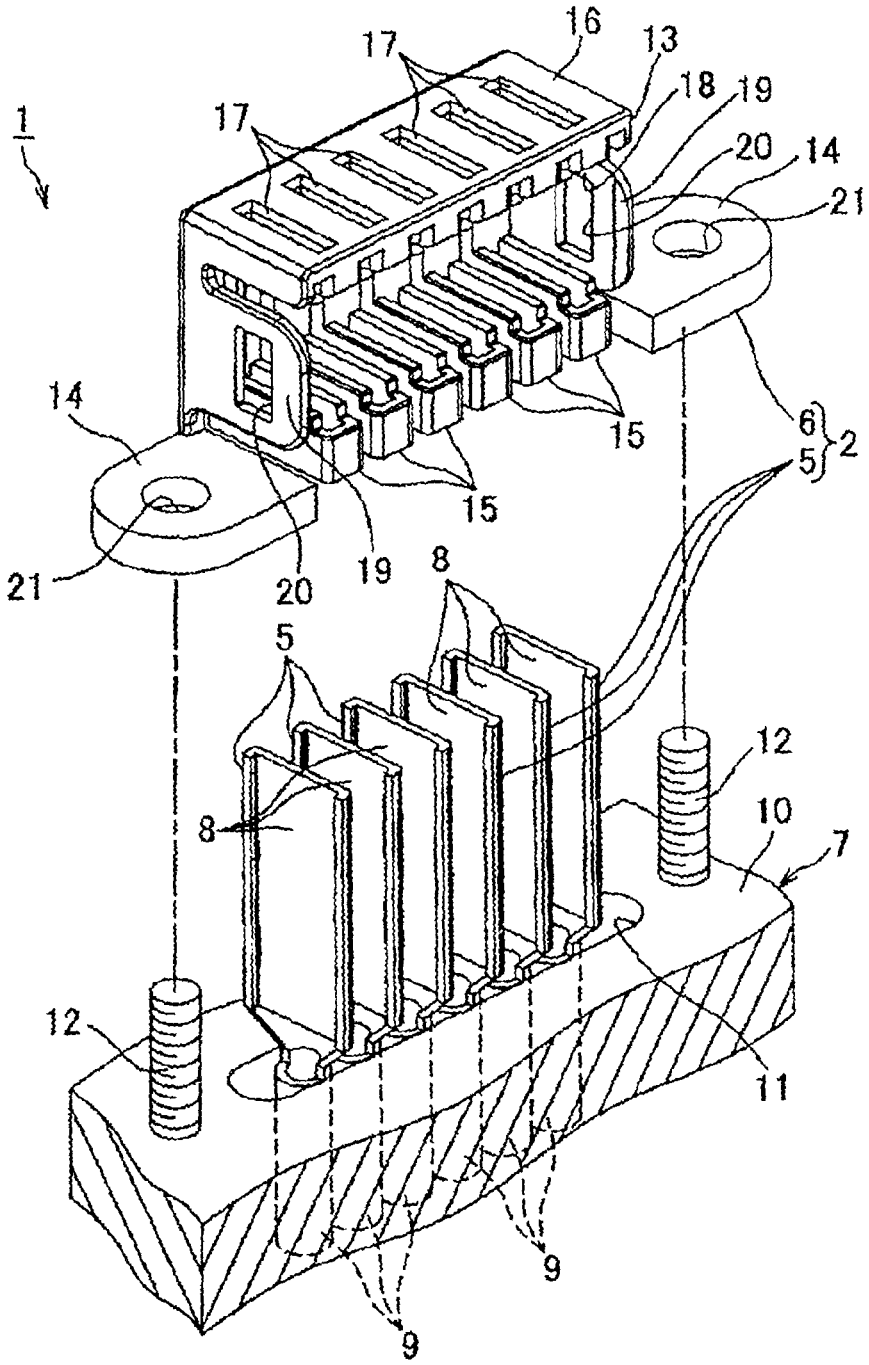
FIG. 3 is a perspective view illustrating a state where a connector housing of a first connector and first terminal fittings of the terminal connection structure illustrated in FIG. 2 face each other.
Figure 4:
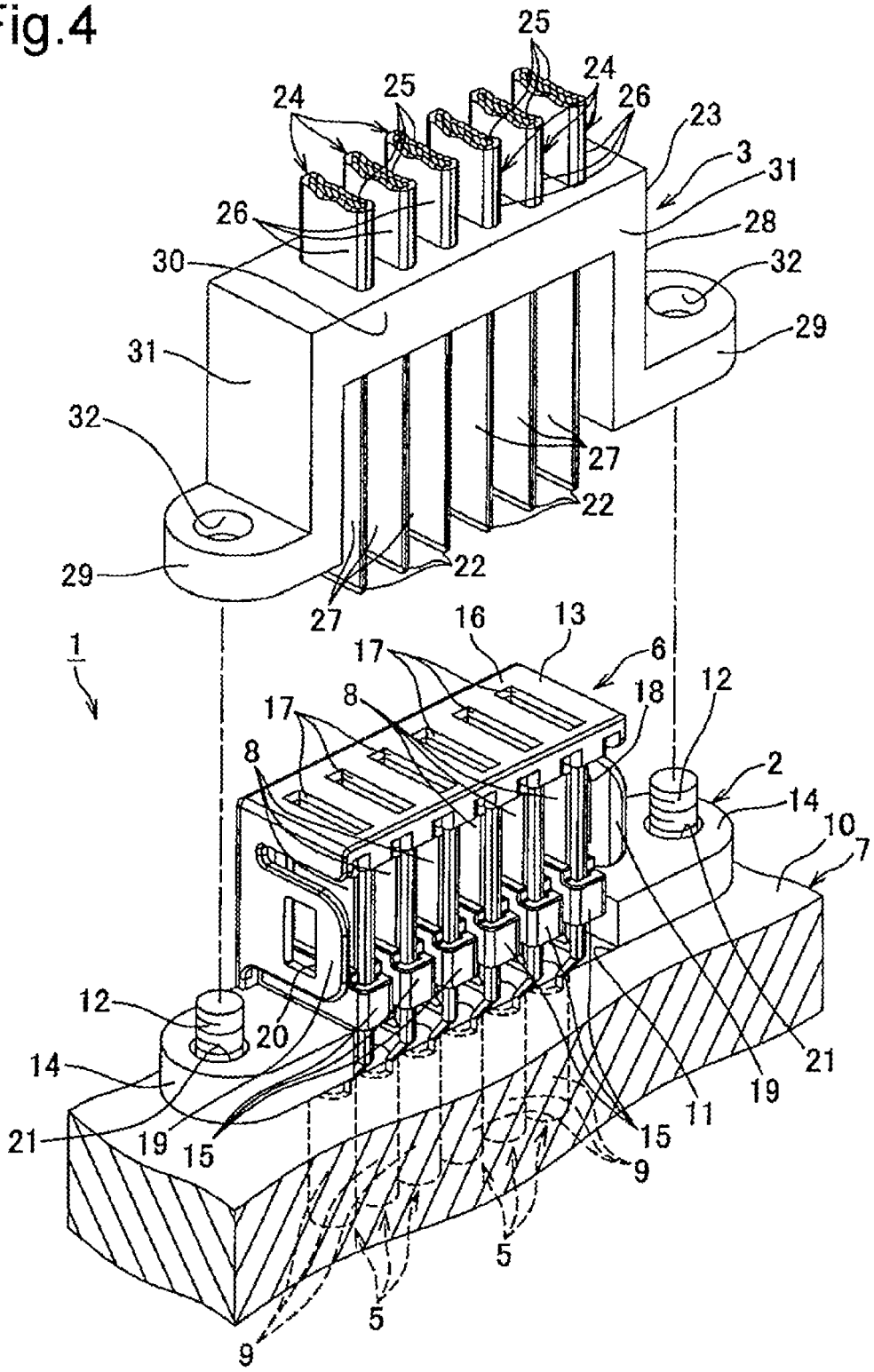
FIG. 4 is a perspective view illustrating a state where a connector housing of a first connector positioned at a motor case and a second connector of the terminal connection structure illustrated in FIG. 3 face each other.

As illustrated in FIG. 3, the connector housing 6 is caused to approach the motor case 10 along the longitudinal direction of the electrical contact portions 8 of the first terminal fittings 5, in a state where a plurality of the cylindrical portions 15 faces the electrical contact portion 8 of the first terminal fittings 5. Then as illustrated in FIG. 4, the connector housing 6 positions the first terminal fittings 5 by passing the electrical contact portions 8 through the inside of the cylindrical portions 15, and is positioned at the motor case 10 by passing the screw axes 12 through the inside of the open holes 21.

As illustrated in FIG. 2, the second connector 3 includes a plurality of second terminal fittings 22 and one connector housing 23. In the illustration example, the second terminal fittings 22 form one side end portion of connection members 24 for connecting the power supply devices to each other. The connection members 24 include bus bars 25 configured of conductive metals and coated portions 26 configured of insulating synthetic resin which coats the central portion of the bus bars 25. In the bus bars 25, the other side end portion (not illustrated) is connected to the inverter as the second power supply device. The bus bars 25 connect the inverter and the motor 7. In addition, the connection members 24 are rolled up, together with the other connection members 24, by a shield sheet (not illustrated) configured of the conductive metal. The shield sheet prevents the electric current flowing inside the bus bars 25 to leak out.

Figure 12:
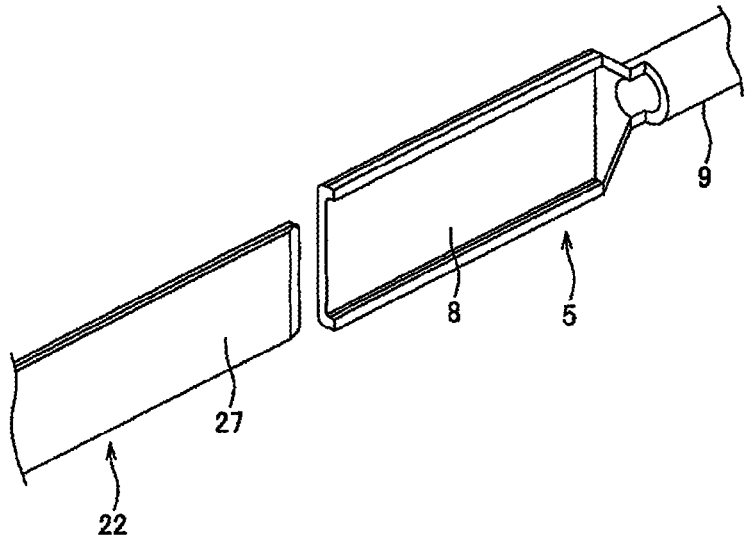
FIG. 12 is a perspective view illustrating an electrical contact portion of first terminal fittings and an electrical contact portion of second terminal fittings of the terminal connection structure illustrated in FIG. 1.

One side end portion of the bus bars 25 is exposed outward from the coated portions 26 and forms the second terminal fittings 22. Of course, the second terminal fittings 22 are integrally formed with the bus bars 25. The second terminal fittings 22 are electrically connected to the inverter as the second power supply device via the other portion excluding the one side end portion of the bus bars 25. As illustrated in FIG. 12, the second terminal fittings 22 include the electrical contact portion 27 which has a band plate shape. The electrical contact portion 27 of the bus bars 25, that is, the second terminal fittings 22, is configured of the aluminum alloy which is softer than the metal (material) such as the copper or copper alloy configuring the first terminal fittings 5.

A plurality of the second terminal fittings 22 is disposed in a state where the electrical contact portions 27 are in parallel, being spaced apart from each other. That is, the electrical contact portions 27 of a plurality of the second terminal fittings 22 are disposed in a state where the surfaces (band plate shaped surfaces) of the electrical contact portions 27 are in parallel, being spaced apart from each other. Furthermore, in the illustration example, six second terminal fittings 22 are provided.

The connector housing 23 is configured of the insulating synthetic resin and includes a main body portion 28 integrally with two flange fixing portions 29. The main body portion 28 includes superimposed girder portions 30 which are superimposed on the wall 16 of the connector housing 6 of the first connector 2 and into which the second terminal fittings 22, that is, the bus bars 25 penetrate, and a pair of arm superimposed girder portions 31 which are continued from both ends in the longitudinal direction of the superimposed girder portions 30 and are superimposed, being spaced apart from the engaging arm 19. The superimposed girder portions 30 together with a pair of the arm superimposed girder portions 31 are formed in a girder shape which is extended into a linear shape.

The flange fixing portions 29 are erected in the outward direction of the main body portion 28 from the edge of the side separated from the superimposed girder portions 30 of a pair of the arm superimposed girder portions 31 of the main body portion 28. The flange fixing portions 29 are superimposed on the flange fixing portion 14 of the connector housing 6 of the first connector, and inside thereof, open holes 32 through which the screw axes 12 are allowed to pass are provided.

Figure 5:
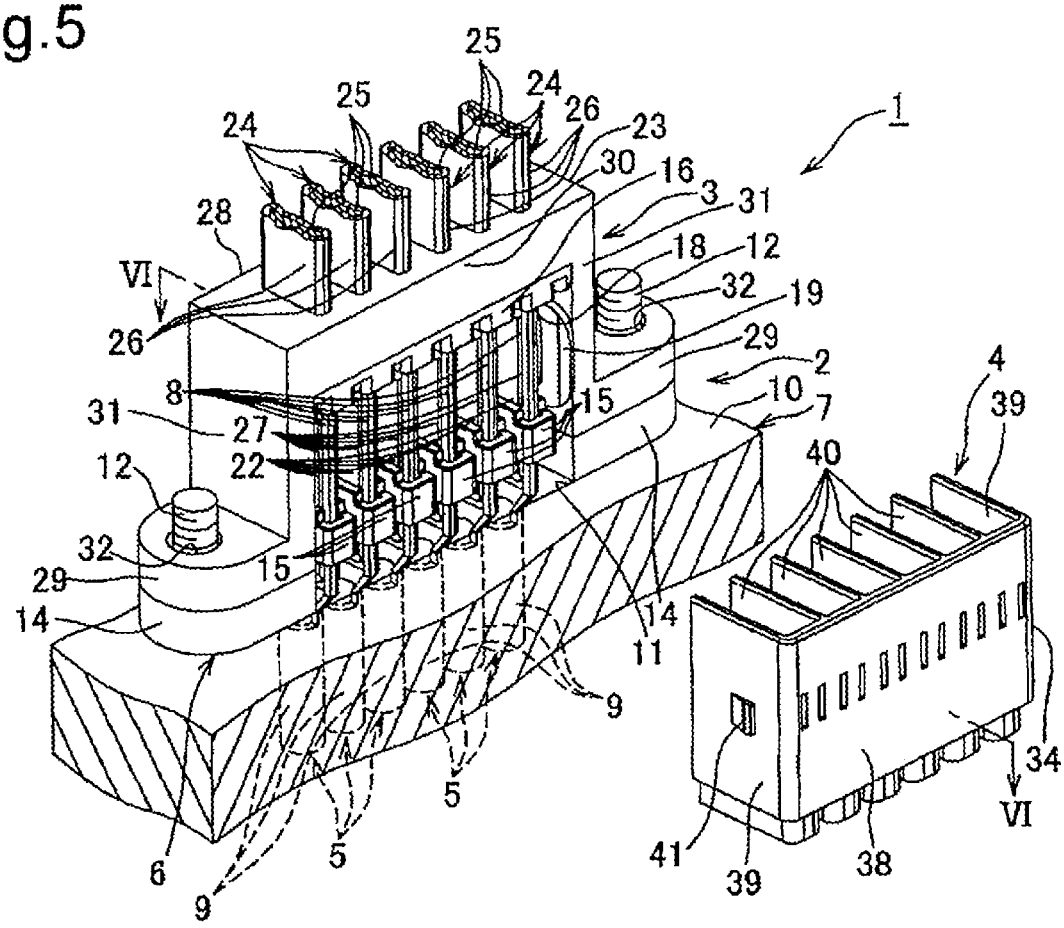
FIG. 5 is a perspective view illustrating a state where a first connector and a second connector positioned at a motor case and a clip connector of the terminal connection structure illustrated in FIG. 4 face each other.

As illustrated in FIG. 4, in a state where the electrical contact portions 27 of the second terminal fittings 22 face the open holes 17 of the connector housing 6 of the first connector 2, the connector housing 23 is caused to approach the first connector 2 along the longitudinal direction of the electrical contact portions 27 of the second terminal fittings 22. Then, the electrical contact portions 27 of the second terminal fittings 22 are allowed to pass through the open holes 17, penetrate into the connector housing 6 of the first connector 2, and are superimposed on the electrical contact portions 8 of the first terminal fittings 5. As illustrated in FIG. 5, the superimposed girder portions 30 are superimposed on the wall 16, the arm superimposed girder portions 31 are superimposed on the engaging arm 19, and the connector housing 23 is superimposed on the connector housing 6 of the first connector 2. Then, the flange fixing portions 29 are superimposed on the flange fixing portions 14 of the first connector 2, the screw axes 12 are allowed to pass through the open holes 32, and the connector housing 23 of the second connector 3 is positioned at the connector housing 6 of the first connector 2.

Figure 9:
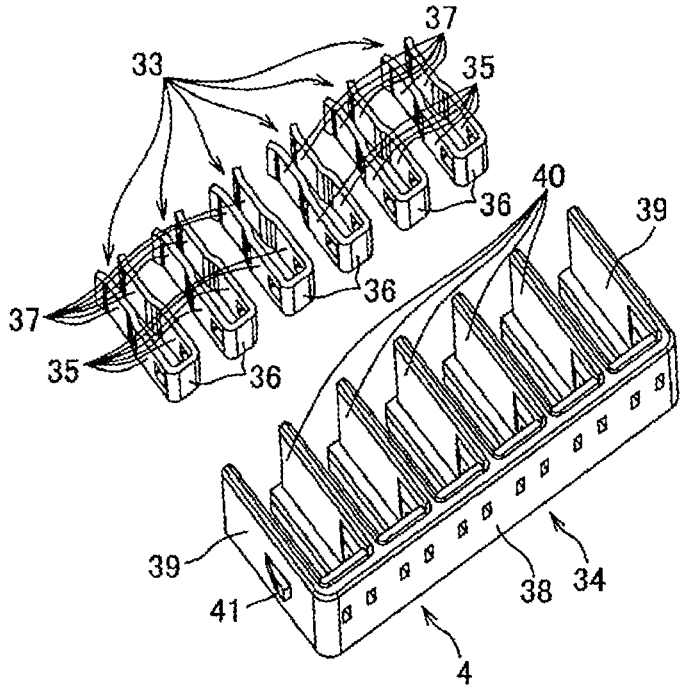
FIG. 9 is a perspective view illustrating an exploded clip connector of the terminal connection structure illustrated in FIG. 1.
Figure 10:
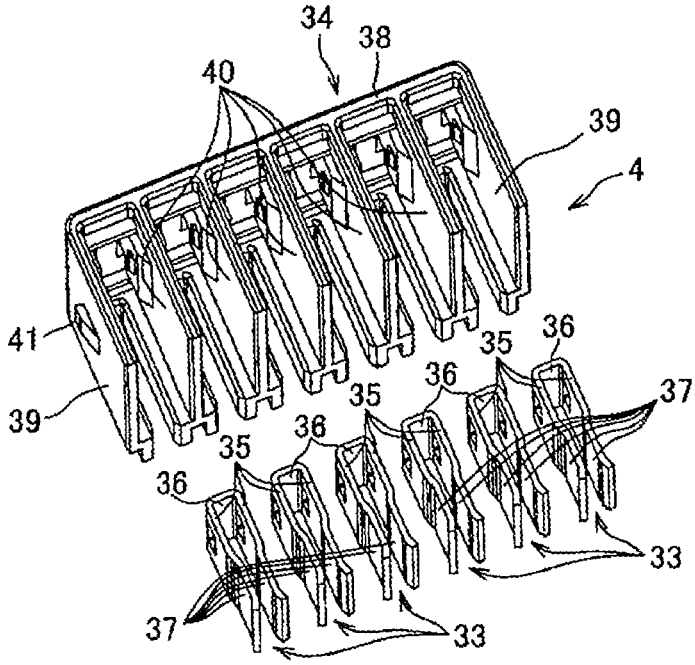
FIG. 10 is another perspective view illustrating an exploded clip connector of the terminal connection structure illustrated in FIG. 1.
Figure 11:
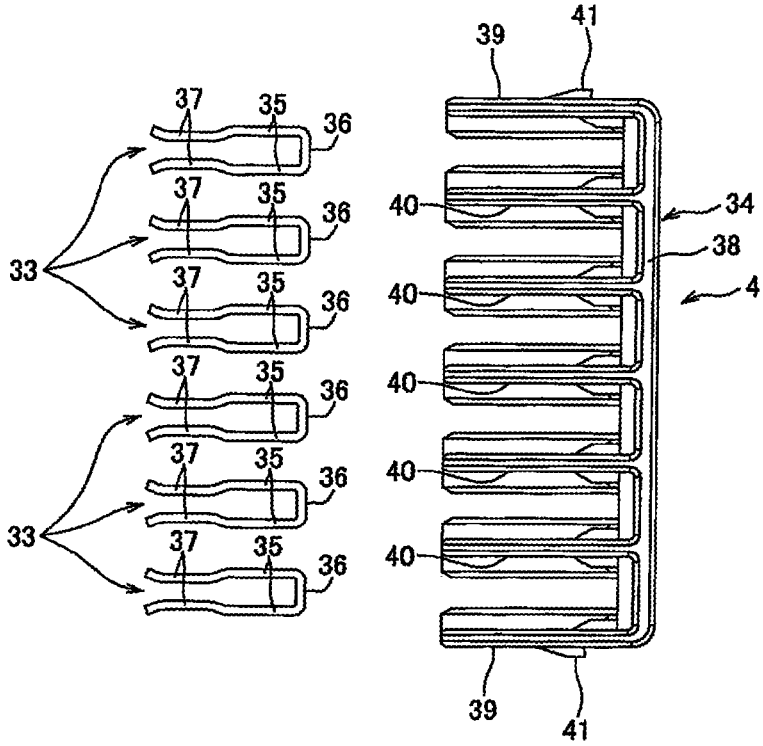
FIG. 11 is a plan view illustrating an exploded clip connector of the terminal connection structure illustrated in FIG. 1.
Figure 13:
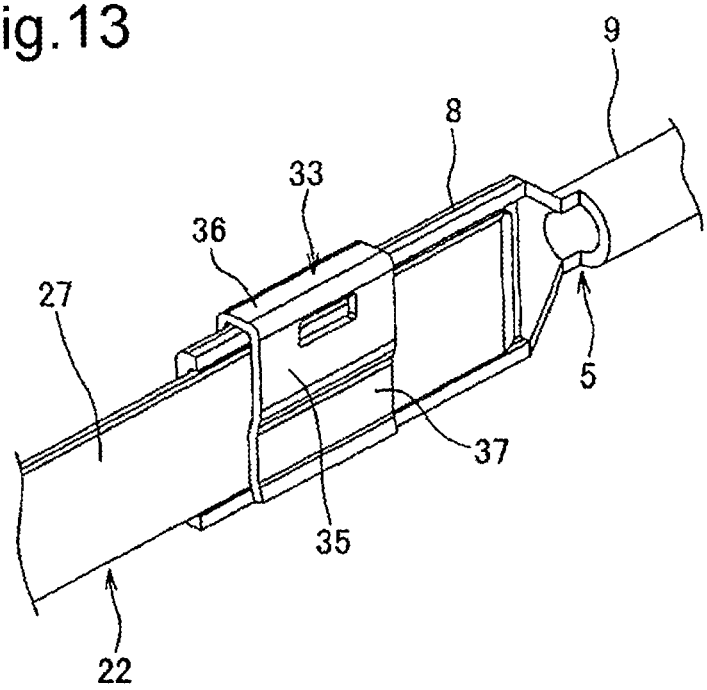
FIG. 13 is a perspective view illustrating a state where an electrical contact portion of first terminal fittings and an electrical contact portion of second terminal fittings which are superimposed on each other, of the terminal connection structure illustrated in FIG. 12, are sandwiched to a clip terminal.

As illustrated in FIGS. 9 and 10, the clip connector 4 includes a plurality of clip terminals 33 and a connector housing 34. The clip terminals 33 are configured of the conductive metal. The clip terminals 33 are provided with the same number as that of the first terminal fittings 5 and the second terminal fittings 22. The clip terminals 33 include a pair of contact pieces 35 which is formed in a substantially flat plate shape and provided in parallel, being spaced apart from each other, and integrally with urging connection portions 36 continued from the respective contact pieces 35. As illustrated in FIG. 11, protruding portions 37 which protrude in a direction where a pair of the contact pieces 35 approaches each other are provided at a pair of the contact pieces 35. As illustrated in FIG. 13, the clip terminals 33 sandwich the electrical contact portions 8 of the first terminal fittings 5 and the electrical contact portions 27 of the second terminal fittings 22 which are superimposed on each other, between a pair of the contact pieces 35. If the electrical contact portions 8 of the first terminal fittings 5 and the electrical contact portions 27 of the second terminal fittings 22 which are superimposed on each other are sandwiched between a pair of the contact pieces 35, the urging connection portions 36 generates an elastic restoring force urging in a direction where a pair of the contact pieces 35 through which the electrical contact portions 8 and 27 are sandwiched approaches each other.

The connector housing 34 is configured of the insulating synthetic resin. As illustrated in FIGS. 9 to 11, the connector housing 34 integrally includes a flat plate shaped wall portion 38, a pair of end walls 39 erected from both ends of the wall portion 38, and five partition walls 40 provided between a pair of end walls 39. The wall portion 38 is formed in a size which is approximately equal to the notched hole 18. A pair of the end walls 39 is respectively formed in a flat plate shape and is in parallel to each other. The end walls 39 include engaging projections 41 which are convex from the outer surface and engage with the engaging arms 19. The partition walls 40 are respectively formed in a flat plate shape and are provided in parallel to each other at equal spaces.

Figure 6:
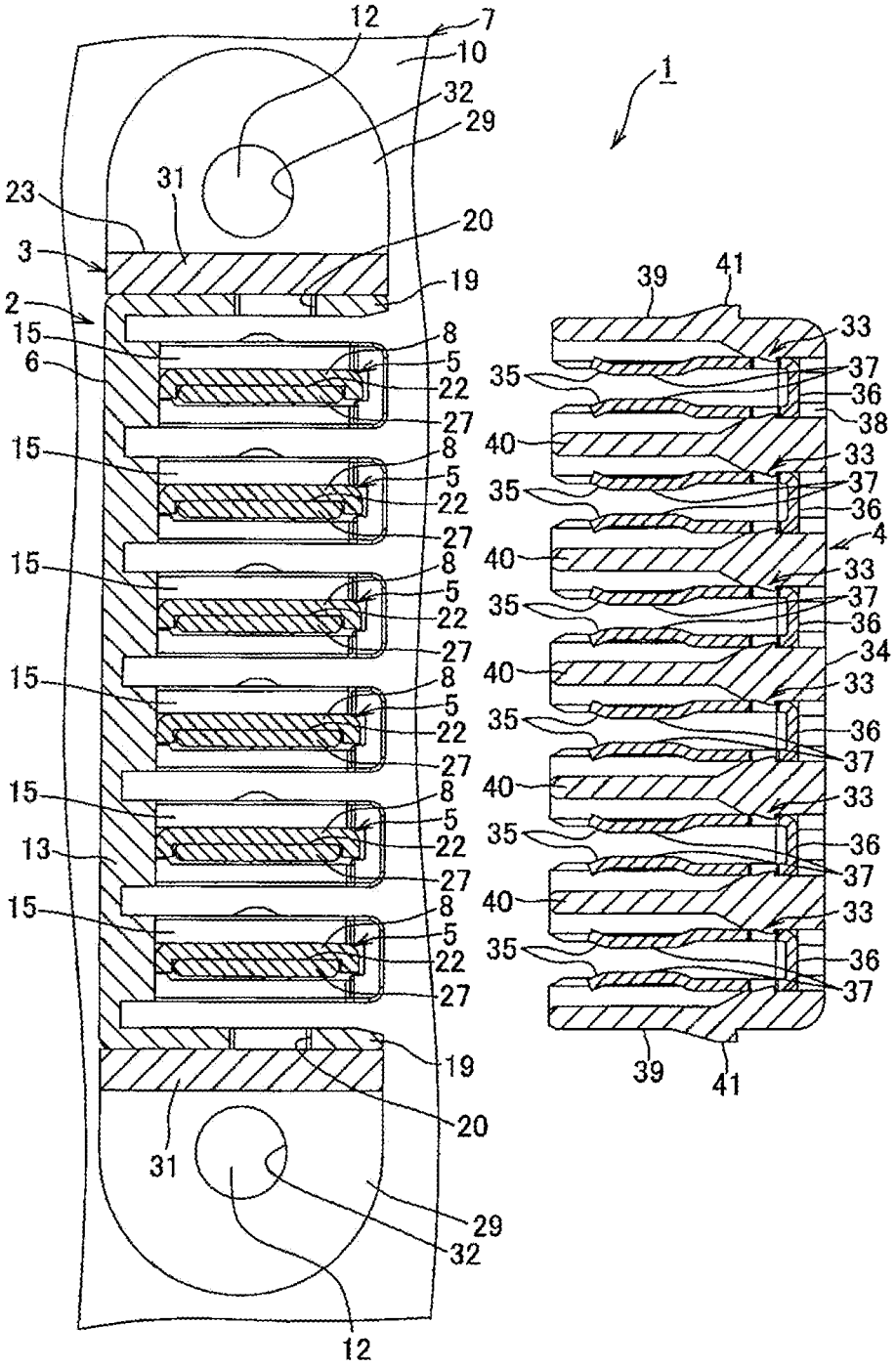
FIG. 6 is a cross-sectional view along the line VI-VI in FIG. 5.
Figure 7:
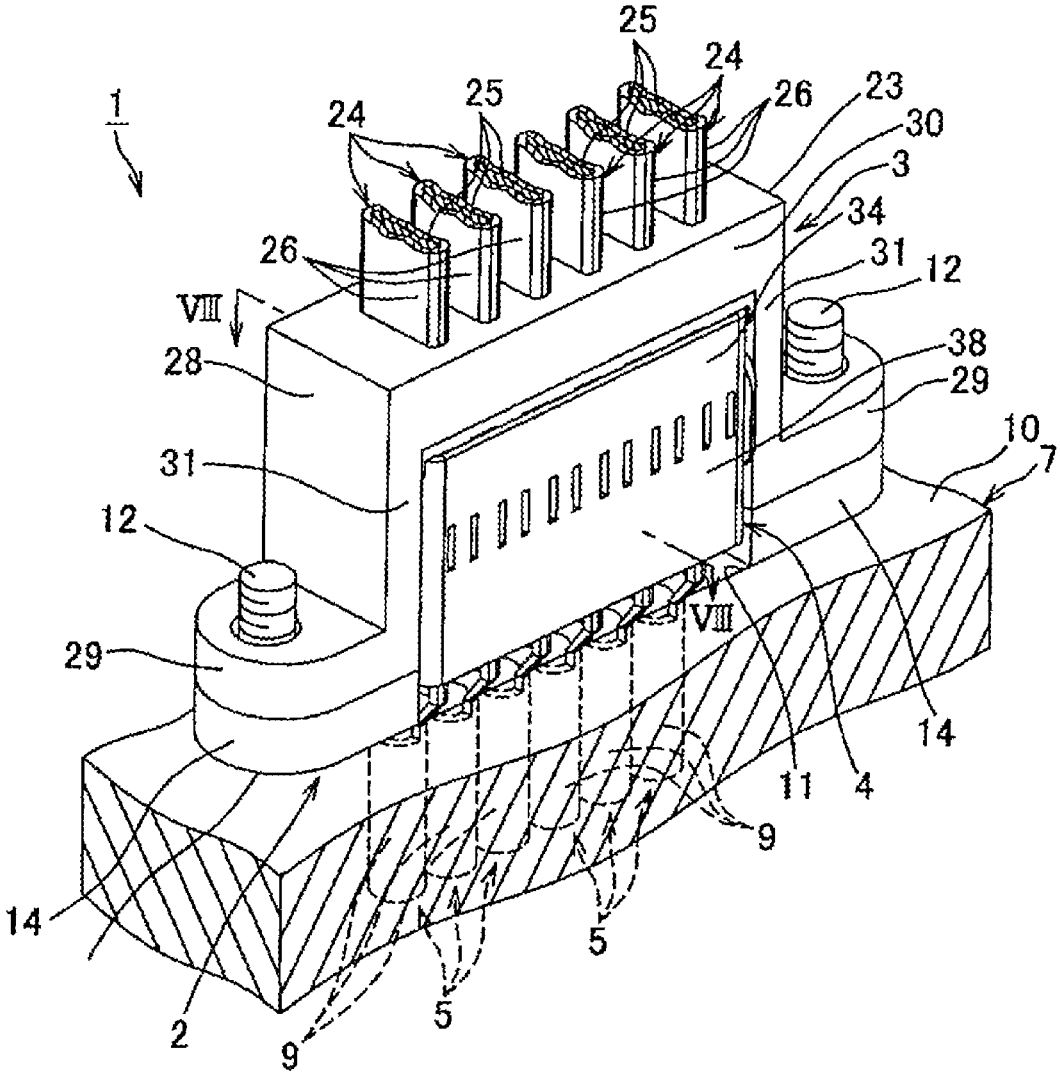
FIG. 7 is perspective view illustrating a state where a first connector and a second connector, and a clip connector of the terminal connection structure illustrated in FIG. 5 are assembled with each other.
Figure 8:
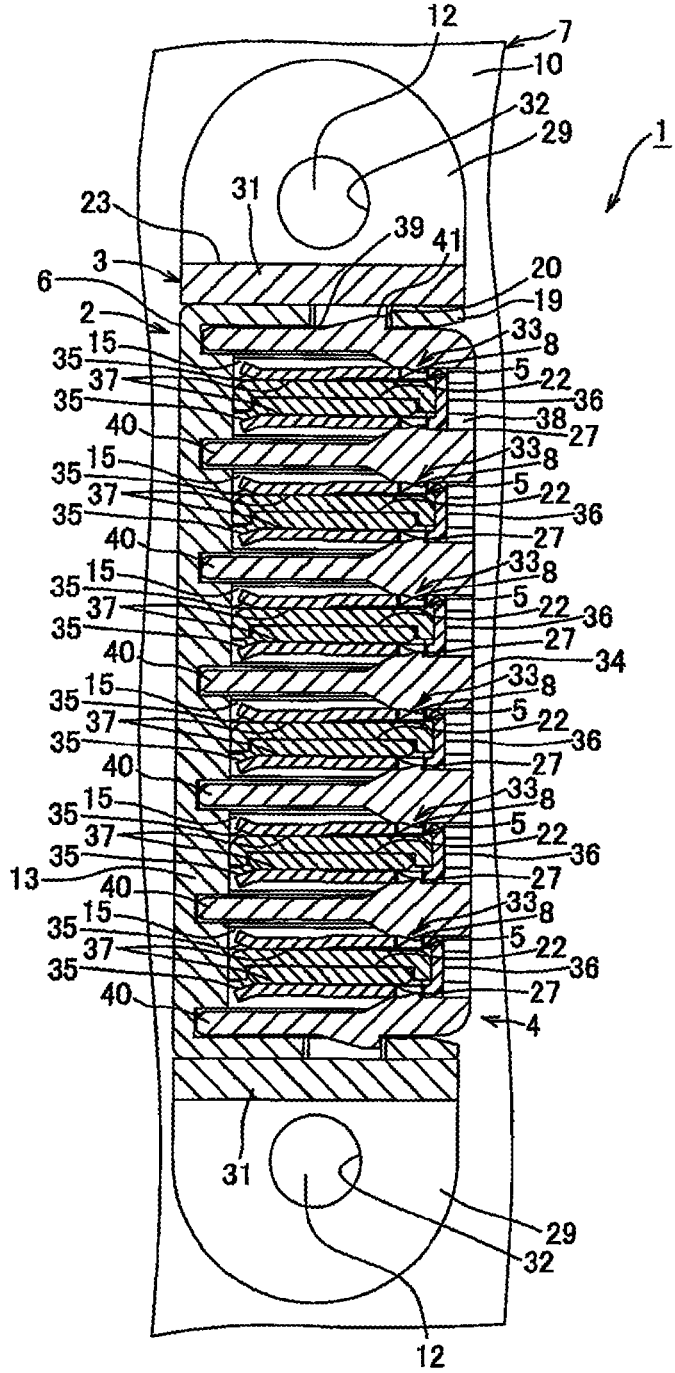
FIG. 8 is a cross-sectional view along the line VII-VII in FIG. 7.

The connector housing 34 of the configuration accommodates the clip terminals 33 between the end walls 39 and the partition walls 40 adjacent to each other. At this time, a pair of the contact pieces 35 of the clip terminals 33 is superimposed on the end walls 39 and the partition walls 40 adjacent to each other. In a state where the connector housing 34 accommodates the clip terminals 33 between the end walls 39 and the partition walls 40 adjacent to each other, as illustrated in FIGS. 5 and 6, the connector housing 34 is positioned in a state of facing the notched holes 18 of the first connector 2 on which the second connector 3 is superimposed and which is positioned at the motor case 10, along the perpendicular (crossing) direction with respect to the longitudinal direction of the electrical contact portions 8 and 27 of the first terminal fittings 5 and the second terminal fittings 22. Then, the connector housing 34 is caused to approach the notched holes 18 such that tip ends of the contact pieces 35 of the clip terminals 33 approach the electrical contact portions 8 and 27 superimposed on each other. Then, of course, the clip terminals 33 are caused to approach the electrical contact portions 8 and 27 along the perpendicular (crossing) direction with respect to the longitudinal direction of the electrical contact portions 8 and 27 of the first terminal fittings 5 and the second terminal fittings 22 superimposed on each other. Then, as illustrated in FIGS. 7 and 8, the electrical contact portions 8 and 27 of the first and the second terminal fittings 22 where the clip terminals 33 are superimposed on each other are sandwiched between a pair of the contact pieces 35. In a form that the wall portion 38 closes the notched hole 18, the engaging projections 41 engage with the engaging arms 19 and the connector housing 34 is fixed to the connector housing 6 of the first connector 2.

The terminal connection structure 1 of the configuration is assembled as follows. First, as illustrated in FIG. 3, in a state where a plurality of the cylindrical portions 15 faces the electrical contact portions 8 of the first terminal fittings 5, the connector housing 6 of the first connector 2 is caused to approach the motor case 10 along the longitudinal direction of the electrical contact portions 8 of the first terminal fittings 5. Then, the connector housing 6 of the first connector 2 allows the electrical contact portions 8 to pass through the cylindrical portions 15, positions the first terminal fittings 5, allows the screw axes 12 to pass through the open holes 21, and as illustrated in FIG. 4, is positioned at the motor case 10.

Thereafter, as illustrated in FIG. 4, in a state where the electrical contact portions 27 of the second terminal fittings 22 face the open holes 17 of the connector housing 6 of the first connector 2, the connector housing 23 of the second connector 3 is caused to approach the first connector 2 along the longitudinal direction of the electrical contact portions 27 of the second terminal fittings 22. Then, the electrical contact portions 27 of the second terminal fittings 22 pass through the open holes 17, penetrate into the connector housing 6 of the first connector 2, are superimposed on the electrical contact portions 8 of the first terminal fittings 5. The superimposed girder portions 30 are superimposed on the wall 16, the arm superimposed girder portions 31 are superimposed on the engaging arms 19, and the connector housing 23 is superimposed on the connector housing 6 of the first connector 2. Then, the flange fixing portion 29 is superimposed on the flange fixing portion 14 of the first connector 2, the screw axes 12 are allowed to pass through the open holes 32, and as illustrated in FIG. 5, the connector housing 23 of the second connector 3 is positioned at the connector housing 6 of the first connector 2.

Then, the connector housing 34 of the clip connector 4 accommodates the clip terminals 33 between the end walls 39 and the partition walls 40 adjacent to each other. As illustrated in FIGS. 5 and 6, the connector housing 34 of the clip connector 4 is positioned in a state of facing the notched holes 18 of the first connector 2 along the perpendicular direction with respect to the longitudinal direction of the electrical contact portions 8 and 27 of the first terminal fittings 5 and the second terminal fittings 22. Then, the connector housing 34 of the clip connector 4 is caused to approach the notched hole 18 such that the tip ends of the contact pieces 35 of the clip terminals 33 approach the electrical contact portions 8 and 27 superimposed on each other. Then, the electrical contact portions 8 and 27 of the first terminal fittings 5 and the second terminal fittings 22 where the clip terminals 33 are superimposed on each other are sandwiched between a pair of the contact pieces 35. In a form that the wall portion 38 closes the notched hole 18, the engaging projections 41 engage with the engaging arms 19 and the connector housing 34 of the clip connector 4 is fixed to the connector housing 6 of the first connector 2, as illustrated in FIGS. 7 and 8. Then, nuts 43 are screwed around the screw axes 12 and thereby the connectors 2, 3 and 4 are fixed to the motor case 10. Furthermore, the connectors 2, 3 and 4 are covered by a shield sheet, and the shield sheet is fixed to the motor case 10. In this manner, the terminal connection structure 1 is assembled and thereby the motor 7 and the inverter are connected to each other.

According to the present embodiment, the electrical contact portions 8 and 27 are connected to each other by sandwiching the electrical contact portions 8 and 27 between a pair of the contact pieces 35 of the clip terminals 33 which are caused to approach the electrical contact portions 8 and 27, along the perpendicular (crossing) direction with respect to the longitudinal direction of the electrical contact portions 8 and 27 of the first and second terminal fittings 5 and 22 superimposed on each other. Therefore, even if the electrical contact portions 8 and 27 of the first and second terminal fittings 5 and 22 are disposed in parallel, being spaced apart from each other, the electrical contact portions 8 and 27 can be reliably connected to each other. Accordingly, in such a manner that the band plate shaped surfaces of the electrical contact portions 8 and 27 of the first and second terminal fittings 5 and 22 are disposed in parallel, being spaced apart from each other, it is possible to reduce the width of the terminal connection structure 1 compared to a case where the band plate shaped surfaces of the electrical contact portions 8 and 27 of the terminal fittings 5 and 22 are disposed on the same plane. Consequently, it is possible to realize the miniaturization of the terminal connection structure 1.

In addition, the clip terminals 33 include a pair of the contact pieces 35 and the urging connection portions 36 which urge a pair of the contact pieces 35 in the direction to approach each other. Accordingly, by the band plate shaped electrical contact portions 8 and 27 which are superimposed on each other being sandwiched between a pair of the contact pieces 35, it is possible to reliably and electrically connect the first terminal fittings 5 and the second terminal fittings 22. Consequently, it is possible to reliably connect the terminal fittings 5 and 22 to each other.

In addition, the band plate shaped electrical contact portions 8 and 27 of the first and second terminal fittings 5 and 22 are disposed in parallel, being spaced apart from each other. Accordingly, it is possible to reduce the width of the terminal connection structure 1 compared to a case where the electrical contact portions 8 and 27 of the terminal fittings 5 and 22 are disposed on the same plane. Consequently, it is possible to realize the miniaturization of the terminal connection structure 1.

Furthermore, between the electrical contact portions 8 and 27 of the first and second terminal fittings 5 and 22, one side is configured of the aluminum alloy which is softer than the material configuring the other side. Therefore, when the clip terminals 33 are urged in a direction where the electrical contact portions 8 and 27 come into close contact with each other, the one side is deformed and then the electrical contact portions 8 and 27 of the first and second terminal fittings 5 and 22 are brought into close contact with each other. Consequently, it is possible to reliably connect the terminal fittings 5 and 22 to each other.

Figure 14:
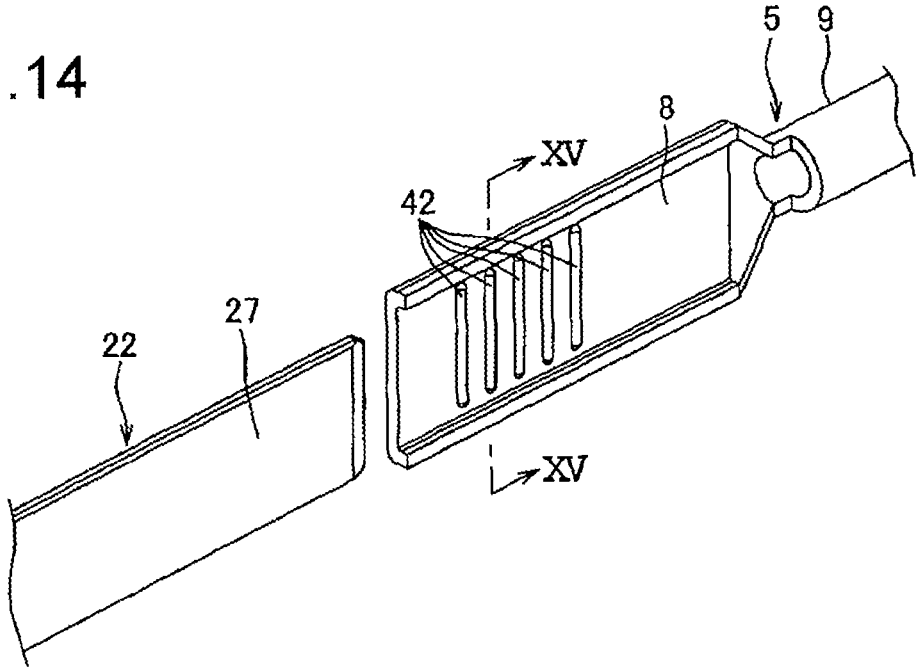
FIG. 14 is a perspective view illustrating a modification example of an electrical contact portion of first terminal fittings and an electrical contact portion of second terminal fittings of the terminal connection structure illustrated in FIG. 12.
Figure 15:
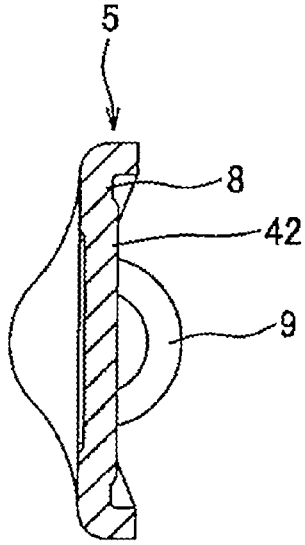
FIG. 15 is a cross-sectional view along the line XV-XV in FIG. 14.

In addition, in a modification example of the present embodiment, as illustrated in FIGS. 14 and 15, the convex portions 42 which protrude toward the surfaces of the electrical contact portions 27 of the second terminal fittings 22 may be provided on the surfaces of the electrical contact portions 8 of the first terminal fittings 5 which are configured of the copper or copper alloy as a harder material (metal) than the aluminum alloy configuring the second terminal fittings 22 between the electrical contact portions 8 of the first terminal fittings 5 and the electrical contact portions 27 of the second terminal fittings 22. Furthermore, in the illustration example, a plurality of the convex portions 42 is provided, being spaced along the longitudinal direction of the electrical contact portions 8 and 27, and are respectively extended into a linear shape along the perpendicular (crossing) direction with respect to the longitudinal direction of the electrical contact portions 8 and 27.

Figure 16:
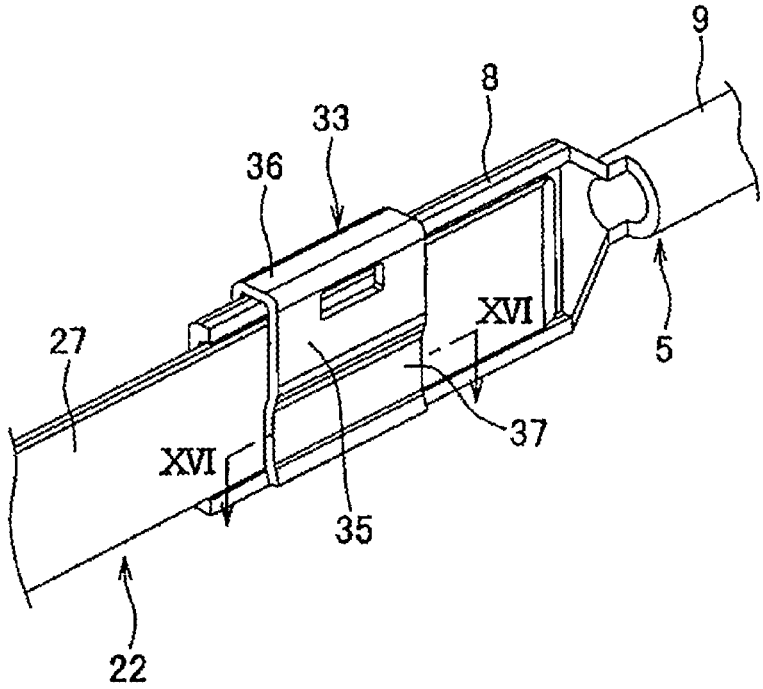
FIG. 16 is a perspective view illustrating a state where an electrical contact portion of first terminal fittings and an electrical contact portion of second terminal fittings which are superimposed on each other, of the terminal connection structure illustrated in FIG. 14, are sandwiched to a clip terminal.
Figure 17:
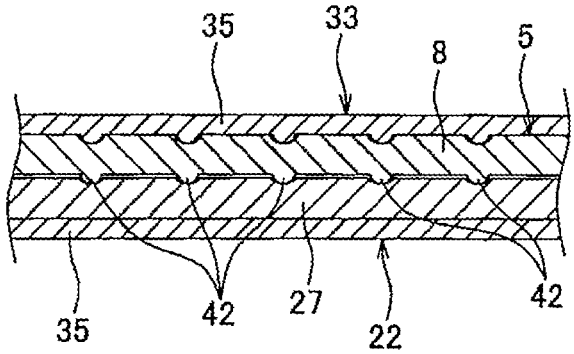
FIG. 17 is a cross-sectional view along the line XVI-XVI in FIG. 16.

In this case, the convex portions 42 are provided at the electrical contact portions 8 of the first terminal fittings 5, between the electrical contact portions 8 and 27 of the first and second terminal fittings 5 and 22, which are not configured of the aluminum alloy. Accordingly, when the clip terminals 33 are urged in the direction where the electrical contact portions 8 and 27 come into close contact with each other as illustrated in FIG. 16, the convex portions 42 penetrate into the electrical contact portions 27 of the second terminal fittings 22 which are configured of the aluminum alloy, as illustrated in FIG. 17 and thereby bring the electrical contact portions 8 and 27 of the first and second terminal fittings 5 and 22 reliably into close contact with each other. Consequently, it is possible to further reliably connect the terminal fittings 5 and 22 to each other.

In addition, the electrical contact portions 8 of the first terminal fittings 5 which are not configured of the aluminum alloy are configured of a harder metal than the aluminum alloy configuring the electrical contact portions 27 of the second terminal fittings 22. Accordingly, when the clip terminals 33 are urged in the direction where the electrical contact portions 8 and 27 come into close contact with each other, the convex portions 42 reliably penetrate into the electrical contact portions 27 of the second terminal fittings 22 and thereby bring the electrical contact portions 8 and 27 of the first and second terminal fittings 5 and 22 reliably into close contact with each other. Consequently, it is possible to further reliably connect the terminal fittings 5 and 22 to each other.

Furthermore, the terminal connection structure of the present invention is described in detail and additionally with reference to the specific embodiments. However, the embodiments are merely representative examples of the present invention and the present invention is not limited to the embodiments. That is, the embodiments can be variously changed within the scope not departing from the gist of the present invention. The present invention is based on Japanese Patent Application (JP-2010-171822) filed on Jul. 30, 2010, the contents of which are incorporated herein by reference.

INDUSTRIAL APPLICABILITY

According to a terminal connection structure of the present invention, it is possible to realize miniaturization of the terminal connection structure which connects power supply devices to each other, to which a voltage is applied for driving a vehicle, and it is possible to reliably connect terminal fittings to each other.

REFERENCE SIGNS LIST

1 terminal connection structure
5 first terminal fittings

7 motor (first power supply device)
8 electrical contact portion
22 second terminal fittings
27 electrical contact portion
33 clip terminal
35 contact piece
36 urging connection portion
42 convex portion

The invention claimed is:

1. A terminal connection structure for connecting a first terminal fitting connected to a first power supply device and a second terminal fitting connected to a second power supply device; wherein:

each of the first terminal fitting and the second terminal fitting includes an electrical contact portion formed in a band plate shape, the electrical contact portions being superimposed on each other;

the terminal connection structure includes a clip terminal including a pair of contact pieces sandwiching the electrical contact portion of the first terminal fitting and the electrical contact portion of the second terminal fitting which are superimposed on each other, and an urging connection portion that is continued from the pair of the contact pieces and urges the pair of the contact pieces between which the electrical contact portions of the first and second terminal fittings are sandwiched in a direction to approach each other;

the clip terminal is caused to approach the electrical contact portions along a crossing direction with respect to the electrical contact portions of the first and second terminal fittings which are superimposed on each other, and that sandwiches the electrical contact portions of the first and second terminal fittings which are superimposed on each other, between the pair of the contact pieces.

2. The terminal connection structure according to claim 1, wherein:

plural electrical contact portions of the first terminal fitting are provided in parallel, spaced apart from each other, and plural electrical contact portions of the second terminal fitting are provided in parallel, being spaced apart from each other.

3. The terminal connection structure according to claim 1, wherein, between the electrical contact portions of the first terminal fittings and the electrical contact portions of the second terminal fittings, one side is configured of an aluminum alloy which is softer than a material configuring the other side.

4. The terminal connection structure according to claim 3, wherein, between the electrical contact portions of the first terminal fittings and the electrical contact portions of the second terminal fittings, convex portions that protrude toward the one side are provided at the other side.

5. The terminal connection structure according claim 4, wherein, between the electrical contact portions of the first terminal fittings and the electrical contact portions of the second terminal fittings, the other side is configured of a harder metal than the one side.

* * * * *